US007632114B2

(12) United States Patent
Danner

(10) Patent No.: US 7,632,114 B2
(45) Date of Patent: Dec. 15, 2009

(54) INTERFACE CONNECTER BETWEEN MEDIA PLAYER AND OTHER ELECTRONIC DEVICES

(75) Inventor: Eliot P. Danner, Arlington, VA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 11/394,459

(22) Filed: Mar. 30, 2006

(65) Prior Publication Data

US 2007/0232098 A1 Oct. 4, 2007

(51) Int. Cl.
*H01R 13/44* (2006.01)

(52) U.S. Cl. ..... 439/131; 439/218

(58) Field of Classification Search ..... 439/105, 439/218, 131

See application file for complete search history.

(56) References Cited

U.S. PATENT DOCUMENTS

| | | | | |
|---|---|---|---|---|
| 4,850,899 | A | 7/1989 | Maynard | |
| 5,055,069 | A | 10/1991 | Townsend et al. | |
| 5,080,603 | A | 1/1992 | Mouissie | |
| 5,104,243 | A | 4/1992 | Harding | |
| 5,108,313 | A | 4/1992 | Adams | |
| D333,460 | S * | 2/1993 | Huang | D13/147 |
| 5,186,646 | A | 2/1993 | Pederson | |
| 5,277,624 | A | 1/1994 | Champion | |
| 5,586,893 | A | 12/1996 | Mosquera | |
| 5,618,045 | A | 4/1997 | Kagan et al. | |
| 5,660,558 | A | 8/1997 | Osanai et al. | |
| 5,830,001 | A | 11/1998 | Kinoshita | |
| 5,901,049 | A | 5/1999 | Schmidt et al. | |
| 5,975,957 | A | 11/1999 | Noda et al. | |
| 5,983,073 | A | 11/1999 | Ditzik | |
| 6,053,773 | A | 4/2000 | Wu | |
| 6,154,798 | A | 11/2000 | Lin et al. | |
| 6,203,345 | B1 | 3/2001 | Roque et al. | |
| 6,206,480 | B1 | 3/2001 | Thompson | |
| 6,267,623 | B1 | 7/2001 | Hisamatsu | |
| 6,304,764 | B1 | 10/2001 | Pan | |

(Continued)

FOREIGN PATENT DOCUMENTS

DE 20104764 U1 7/2001

(Continued)

OTHER PUBLICATIONS

International Search Report in corresponding PCT application PCT/US2007/007344 dated Aug. 21, 2007.
Written Opinion in corresponding PCT application PCT/US2007/007344 dated Aug. 21, 2007.

(Continued)

*Primary Examiner*—Tho D Ta
*Assistant Examiner*—Travis Chambers
(74) *Attorney, Agent, or Firm*—Townsend and Townsend and Crew LLP

(57) ABSTRACT

An interface connector is disclosed. The connector enables a compact communication link between a media player and a CPU configured so that the interface enables the media player to operate as a USB memory drive for the CPU. In one embodiment, the invention comprises an interface that is removably engagable from a media player and another electronic device. The interface includes a rigid housing with a first and second end connectors that are configured to facilitate data and power transmission between a media player and an electronic device when connected to the interface. The interface connector can be configured to be very compact and easily transportable.

32 Claims, 7 Drawing Sheets

U.S. PATENT DOCUMENTS

| | | | | |
|---|---|---|---|---|
| 6,314,479 | B1 | 11/2001 | Frederick et al. | |
| 6,319,061 | B1 | 11/2001 | Chen et al. | |
| 6,322,396 | B1 | 11/2001 | Kuan | |
| 6,344,727 | B1 | 2/2002 | Desai et al. | |
| 6,354,713 | B1 | 3/2002 | Leifer et al. | |
| 6,394,813 | B1 | 5/2002 | Stout et al. | |
| 6,431,915 | B1 | 8/2002 | Ko | |
| 6,454,592 | B2 | 9/2002 | Takagi | |
| 6,457,996 | B1 | 10/2002 | Shih | |
| 6,461,173 | B1 | 10/2002 | Mizuno et al. | |
| 6,464,542 | B1 | 10/2002 | Lee | |
| 6,468,110 | B2 | 10/2002 | Fujino et al. | |
| 6,478,603 | B1 | 11/2002 | Wu | |
| 6,485,328 | B1 | 11/2002 | Wu | |
| 6,524,119 | B2 | 2/2003 | Kato et al. | |
| 6,552,567 | B1 | 4/2003 | Boles et al. | |
| 6,577,877 | B1 | 6/2003 | Charlier et al. | |
| 6,589,076 | B1 | 7/2003 | Davis et al. | |
| 6,591,085 | B1 | 7/2003 | Grady | |
| 6,608,264 | B1 | 8/2003 | Fouladpour | |
| 6,616,473 | B2 | 9/2003 | Kamata et al. | |
| 6,648,695 | B1 | 11/2003 | Wu | |
| 6,653,813 | B2 | 11/2003 | Khatri | |
| 6,663,420 | B1 * | 12/2003 | Xiao | 439/502 |
| 6,674,995 | B1 | 1/2004 | Meyers et al. | |
| 6,728,546 | B1 | 4/2004 | Peterson et al. | |
| 6,729,897 | B2 * | 5/2004 | Lai | 439/347 |
| 6,754,468 | B1 | 6/2004 | Sieben et al. | |
| 6,776,626 | B2 | 8/2004 | Huang et al. | |
| 6,776,665 | B2 | 8/2004 | Huang | |
| 6,786,734 | B2 * | 9/2004 | Yu | 439/11 |
| 6,799,226 | B1 | 9/2004 | Robbin et al. | |
| 6,813,528 | B1 | 11/2004 | Yang | |
| 6,816,376 | B2 | 11/2004 | Bright et al. | |
| 6,859,854 | B2 | 2/2005 | Kwong | |
| D503,681 | S * | 4/2005 | Huang | D13/147 |
| 6,908,324 | B1 * | 6/2005 | Morley et al. | 439/218 |
| 6,991,483 | B1 | 1/2006 | Milan et al. | |
| 7,004,787 | B2 | 2/2006 | Milan | |
| 7,054,963 | B2 | 5/2006 | Betts-LaCroix et al. | |
| 7,090,538 | B1 * | 8/2006 | Huang | 439/638 |
| 7,280,802 | B2 * | 10/2007 | Grady | 455/42 |
| 2002/0002035 | A1 | 1/2002 | Sim et al. | |
| 2002/0010759 | A1 | 1/2002 | Hitson et al. | |
| 2002/0029303 | A1 | 3/2002 | Nguyen | |
| 2002/0032042 | A1 | 3/2002 | Poplawsky et al. | |
| 2002/0065074 | A1 | 5/2002 | Cohn et al. | |
| 2002/0068610 | A1 | 6/2002 | Anvekar et al. | |
| 2002/0072390 | A1 | 6/2002 | Uchiyama | |
| 2002/0103008 | A1 | 8/2002 | Rahn et al. | |
| 2002/0115480 | A1 | 8/2002 | Huang | |
| 2002/0132651 | A1 | 9/2002 | Jinnouchi | |
| 2002/0151327 | A1 | 10/2002 | Levitt | |
| 2002/0156546 | A1 | 10/2002 | Ramaswamy | |
| 2002/0163780 | A1 | 11/2002 | Christopher | |
| 2002/0173273 | A1 | 11/2002 | Spurgat et al. | |
| 2002/0180803 | A1 | 12/2002 | Kaplan et al. | |
| 2003/0017746 | A1 | 1/2003 | Lee | |
| 2003/0028664 | A1 | 2/2003 | Tan et al. | |
| 2003/0032419 | A1 | 2/2003 | Shibasaki et al. | |
| 2003/0041206 | A1 | 2/2003 | Dickie | |
| 2003/0059022 | A1 | 3/2003 | Nebiker et al. | |
| 2003/0067741 | A1 | 4/2003 | Alfonso et al. | |
| 2003/0073432 | A1 | 4/2003 | Meade | |
| 2003/0079038 | A1 | 4/2003 | Robbin et al. | |
| 2003/0097379 | A1 | 5/2003 | Ireton | |
| 2003/0198015 | A1 | 10/2003 | Vogt | |
| 2003/0218445 | A1 | 11/2003 | Behar | |
| 2003/0236075 | A1 | 12/2003 | Johnson et al. | |
| 2004/0039860 | A1 | 2/2004 | Mills et al. | |
| 2004/0048494 | A1 | 3/2004 | Yu | |
| 2004/0048569 | A1 | 3/2004 | Kawamura | |
| 2004/0090998 | A1 | 5/2004 | Chen | |
| 2004/0162029 | A1 | 8/2004 | Grady | |
| 2004/0186935 | A1 | 9/2004 | Bell et al. | |
| 2004/0198436 | A1 | 10/2004 | Alden | |
| 2004/0224638 | A1 * | 11/2004 | Fadell et al. | 455/66.1 |
| 2004/0235339 | A1 | 11/2004 | Sato et al. | |
| 2004/0267825 | A1 | 12/2004 | Novak et al. | |
| 2005/0014536 | A1 | 1/2005 | Grady | |
| 2005/0170699 | A1 * | 8/2005 | Overtoom | 439/639 |
| 2005/0186854 | A1 * | 8/2005 | Huang | 439/677 |
| 2005/0227811 | A1 * | 10/2005 | Shum et al. | 482/1 |
| 2005/0239333 | A1 | 10/2005 | Watanabe et al. | |
| 2005/0265569 | A1 * | 12/2005 | Langberg et al. | 381/334 |
| 2006/0116009 | A1 * | 6/2006 | Langberg et al. | 439/76.1 |
| 2006/0154530 | A1 * | 7/2006 | Novotney et al. | 439/660 |
| 2006/0286840 | A1 * | 12/2006 | Freeman et al. | 439/218 |

FOREIGN PATENT DOCUMENTS

| | | | |
|---|---|---|---|
| DE | 101 31 299 | A1 | 1/2003 |
| DE | 202004001805 | U1 | 7/2004 |
| EP | 1 104 150 | A2 | 5/2001 |
| EP | 1 168 770 | A | 1/2002 |
| EP | 1 176 783 | A2 | 1/2002 |
| EP | 1 618 675 | A1 | 11/2004 |
| GB | 2270212 | A | 3/1994 |
| GB | 2 362 237 | A | 11/2001 |
| GB | 2394124 | A | 4/2004 |
| JP | 7-176351 | A | 7/1995 |
| JP | 10-321302 | A | 12/1998 |
| JP | 10-334993 | A | 12/1998 |
| JP | 2000-223215 | A | 8/2000 |
| JP | 2000-223216 | A | 8/2000 |
| JP | 2000-223218 | A | 8/2000 |
| JP | 2001-35603 | A | 2/2001 |
| JP | 2001-196133 | A | 7/2001 |
| JP | 2001-230021 | A | 8/2001 |
| JP | 2001-332350 | A | 11/2001 |
| JP | 2002-25720 | A | 1/2002 |
| JP | 2002-203641 | A | 7/2002 |
| JP | 2003-17165 | A | 1/2003 |
| WO | WO 00/60450 | A1 | 10/2000 |
| WO | WO 01/17262 | A1 | 3/2001 |
| WO | WO 01/62004 | A1 | 8/2001 |
| WO | WO 02/43359 | A2 | 5/2002 |
| WO | WO 02/087205 | A1 | 10/2002 |
| WO | WO 02/103545 | A2 | 12/2002 |
| WO | WO 2004/084413 | A2 | 9/2004 |
| WO | WO 2004/098079 | A1 | 11/2004 |

OTHER PUBLICATIONS

Sinitsyn, Alexander, "A Synchronization Framework for Personal Mobile Servers," *Pervasive Computing and Communications Workshops* (*PERCOMW'04*). Proceedings of the Second IEEE Annual Conference, Piscataway, NJ, USA, IEEE, Mar. 14, 2004, pp. 208-212.

International Search Report dated May 21, 2007 from PCT Application No. PCT/US2006/048670.

Derman, Glenda; "Monitors Make Net Connections"; 1996, *Electronic Engineering Times*, vol. 933, pp. 60 and 69.

Lewis, Peter; "On Technology"; 2002, *Fortune Magazine*, pp. 240.

"iPodDock/iPod Cradle"; www.bookendz/dock_cradle.htm, downloaded Feb. 27, 2003, 2 pages.

"Neuros MP3 Digital Audio Computer"; www.neurosaudio.com, downloaded Apr. 9, 2003, 6 pages.

Bindra, Ashok, "Standard Turns Monitor into I/O Hub," 1996, *Electronic Engineering Times*, vol. 918, p. 14.

Supplementary European Search Report dated Mar. 14, 2008 from European Application No. 04760202 (4 pages).

* cited by examiner

PIN DESIGNATION CHART

| PIN # | Signal name | I/O | Function |
|---|---|---|---|
| 1 | F/W GND | Input | Firewire and charger ground |
| 2 | F/W GND | Input | Firewire and charger ground |
| 3 | TPA+ | I/O | Firewire signal |
| 4 | USB D+ | I/O | USB Signal |
| 5 | TPA- | I/O | Firewire signal |
| 6 | USB D- | I/O | USB Signal |
| 7 | TPB+ | I/O | Firewire signal |
| 8 | USB PWR | Input | USB power in, this is not used for powering, but to detect a connection to a USB host |
| 9 | TPB- | I/O | Firewire signal |
| 10 | Accessory Identify | Input | Pull down in dock to notify media player of specific device |
| 11 | F/W PWR+ | Input | Firewire and charger input power (8V to 30V DC) |
| 12 | F/W PWR+ | Input | Firewire and charger input power (8V to 30V DC) |
| 13 | ACCESSORY PWR (3V3) | Output | 3.3V output from media player, current limited to 100mA for powering accessories |
| 14 | Reserved | | |
| 15 | USB GND | GND | Digital ground in media player |
| 16 | DGND | GND | Digital ground in media player |
| 17 | Reserved | | |
| 18 | Dock Tx | | Serial protocol (Data To media player) |
| 19 | Dock Rx | | Serial protocol (Data From media player) |
| 20 | Accessory Detect | I/O | |
| 21 | Reserved | | |
| 22 | Reserved | | |
| 23 | Reserved | | |
| 24 | Reserved | | |
| 25 | LINE-IN L | Input | Line level input to the media player for the left channel |
| 26 | LINE-IN R | Input | Line level input to the media player for the right channel |
| 27 | LINE-OUT L | Output | Line level output to the media player for the left channel |
| 28 | LINE-OUT R | Output | Line level output to the media player for the right channel |
| 29 | Audio Return | GND | Audio return - Signal, never to be grounded inside accessory |
| 30 | DGND | GND | Digital ground in media player |
| 31 | Chassis | | Chassis ground for connector shell |
| 32 | Chassis | | Chassis ground for connector shell |

FIG. 6C

INTERFACE CONNECTER BETWEEN MEDIA PLAYER AND OTHER ELECTRONIC DEVICES

BACKGROUND OF THE INVENTION

1. Field of the Invention

The present invention relates generally to a media player interface connector. More particularly, the present invention relates to improved features for connecting the media player to an external USB port using a one-piece connector.

2. Description of the Related Art

The hand held consumer electronics market is exploding, and an increasing number of those products are including mechanism for expanding connections thereto. By way of example, hand held consumer electronic products may correspond to cellular phones, personal digital assistants (PDAs), video games, radios, MP3 players, CD players, DVD players, televisions, game players, cameras, etc. Most of these devices include some sort of connector for making connections to other devices (e.g., Firewire, USB, audio out, video in, etc.). Some of these devices have been capable of connections to other devices through docking stations. For example, cellular phones have included docking stations for charging the cellular phones and PDAs have included docking stations for communicating with a host computer. Other devices have been capable of wireless connections therebetween. For example, cellular phones use wireless connections to communicate back and forth (e.g., include wireless receivers).

MP3 music players in particular have typically made connections to other devices through connectors. For example, the MP3 music player known as the iPod manufactured by Apple Computer of Cupertino, Calif. has included a Firewire connector for communicating with a computer. Although such a Firewire connector generally allows data transmissions to travel back and forth between the MP3 music player and the computer, it is a long cable that is not compact and does not have a rigid case. As should be appreciated, MP3 music players are configured to play MP3 formatted songs. These songs may be uploaded from the computer and thereafter stored in the MP3 player. As is generally well known, the MP3 format is a compression system for digital music that helps reduce the size of a digitized song without hurting the sound quality, i.e., compress a CD-quality song without losing the CD sound quality. By way of example, a 32 MB song on a CD may compress down to about a 3 MB song using the MP3 format. This generally lets a user download a song in minutes rather than hours. Additionally, and advantageously, the iPod can be configured as a portable memory storage type device enabling standard memory information (i.e., non-music related memory) to be downloaded into the device for transport and transfer to other devices. Such an implementation could be used to use an iPod as a portable "hard drive" for example.

Although current media players such as work well to transfer data in such a manner, there is a continuing need for improved features and interconnection approaches for connecting or coupling media players to one or more external devices (e.g., input or output).

SUMMARY OF THE INVENTION

The invention relates, in one embodiment, to an interface that enables a connection between a media player and a computer. The interface enables the media player to operate as a USB memory drive.

In one embodiment, the invention comprises removably engagable interface for connecting a media player with other electronic devices. Such interfaces are configured to enable data and power transmission between the media player and said electronic device, the interface including a rigid housing with a first and a second end connector. The first end connector is for connecting with a media player and includes a plurality of electrical contacts arranged to enable data and power transmissions to pass between the media player and the second end connector. The second end connector includes a plurality of electrical contacts arranged in the connector thereby enabling said data and power transmissions to pass between the media player and the other electronic device.

The invention relates, in another embodiment, to a method of connecting a hand held media player to another device. The method includes transferring data between a media player and computer device. The method involves connecting a communication port of a media player to a first end connector of an interface connector having a rigid housing that holds the first end connector and the second end connector. The connector enables electric connections between the first and second end connectors and is configured to transfer data information between the first and second end connectors. The second end connector of the interface connector is connected to the CPU to enable the transfer of data information between the media player and the CPU through the interface connector. Once connected the method involves transferring data between the media player and the CPU and saving the data in a memory of at least one of the media player and the CPU.

These and other aspects and advantages of the invention will become apparent from the following detailed description and accompanying drawings which illustrate, by way of example, the principles of the invention.

BRIEF DESCRIPTION OF THE DRAWINGS

The present invention is illustrated by way of example, and not by way of limitation, in the figures of the accompanying drawings and in which like reference numerals refer to similar elements and in which:

FIG. 6C is a pin designation chart, in accordance with one embodiment of the present invention.

DETAILED DESCRIPTION OF THE INVENTION

The present invention will now be described in detail with reference to a few preferred embodiments thereof as illustrated in the accompanying drawings. In the following description, numerous specific details are set forth in order to provide a thorough understanding of the present invention. It will be apparent, however, to one skilled in the art, that the present invention may be practiced without some or all of these specific details. In other instances, well known process steps have not been described in detail in order not to unnecessarily obscure the present invention.

The inventors are aware that media players include large memory elements capable of storing data comprising 20GB or more in the memory elements. This memory is versatile and can be configured to operate as portable hard drive or a portable USB drive such as are commonly found in so-called USB "flash memory" and drives in common usage. Current connector technologies require the implementation of long cord with interface plugs at either end configured to connect the media player with a computer. These are inconvenient and difficult to quickly use. The inventor has conceived of a connector interface having a hard connector shell with one end configured to connect with the USB port of a computer and another end configured to connect with the media player. This interface is to be small and convenient to carry.

Figure 1:
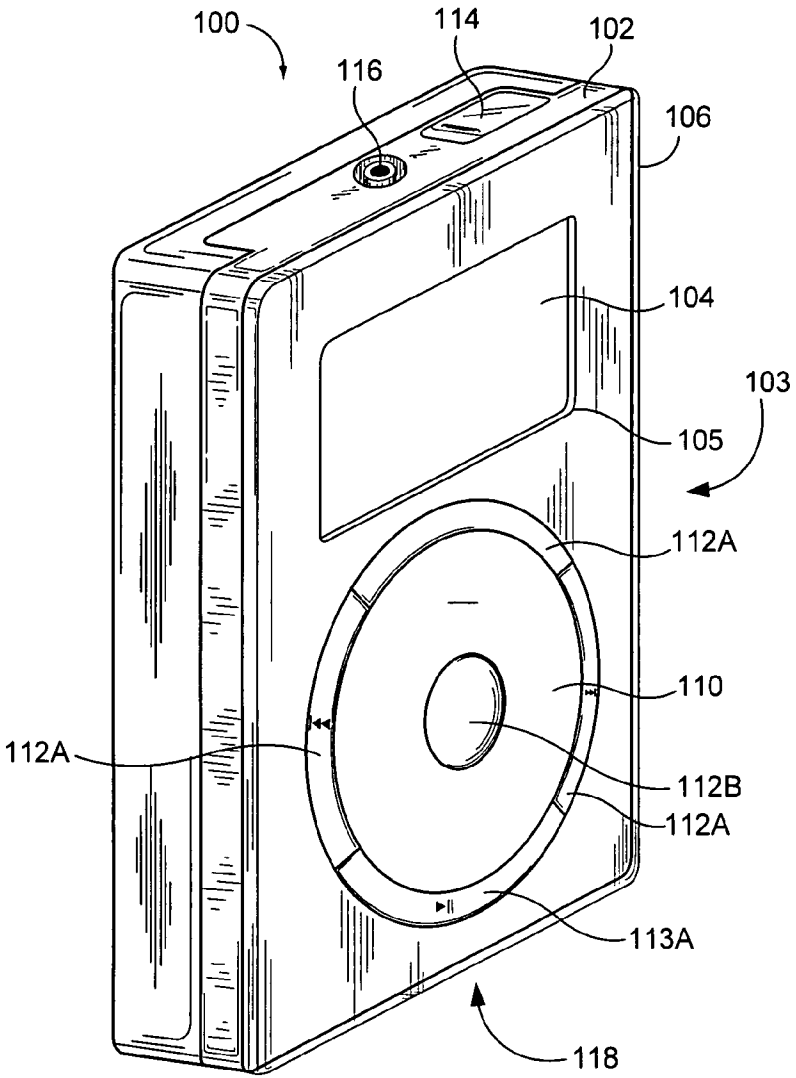
FIG. 1 is a perspective view of a media player, in accordance with one embodiment of the present invention.

FIG. 1 is a perspective diagram of a media player 100, in accordance with one embodiment of the present invention. The term "media player" generally refers to computing devices that are dedicated to processing media such as audio, video or other images, as for example, music players, game players, video players, video recorders, cameras, and the like. In some cases, the media players contain single functionality (e.g., a media player dedicated to playing music) and in other cases the media players contain multiple functionality (e.g., a media player that plays music, displays video, stores pictures and the like). In either case, these devices are generally portable so as to allow a user to listen to music, play games or video, record video or take pictures wherever the user travels.

In one embodiment, the media player is a handheld device that is sized for placement into a pocket of the user. By being pocket sized, the user does not have to directly carry the device and therefore the device can be taken almost anywhere the user travels (e.g., the user is not limited by carrying a large, bulky and often heavy device, as in a laptop or notebook computer). For example, in the case of a music player, a user may use the device while working out at the gym. In case of a camera, a user may use the device while mountain climbing. In the case of a game player, the user can use the device while traveling in a car. Furthermore, the device may be operated by the users hands, no reference surface such as a desktop is needed. In the illustrated embodiment, the media player 100 is a pocket sized hand held MP3 music player that allows a user to store a large collection of music (e.g., in some cases up to 4,000 CD-quality songs). Although used primarily for storing and playing music, the MP3 music player shown herein may also include additional functionality such as storing a calendar and phone lists, storing and playing games, storing photos and the like. In fact, in some cases, it may act as a highly transportable storage device.

By way of example, the MP3 music player may correspond to the Ipod MP3 player manufactured by Apple Computer of Cupertino, Calif. The pocket sized Ipod has a width of about 2.4 inches, a height of about 4 inches and depths ranging from about 0.72 to about 0.84 inches.

As shown in FIG. 1, the media player 100 includes a housing 102 that encloses internally various electrical components (including integrated circuit chips and other circuitry) to provide computing operations for the media player 100. In addition, the housing may also define the shape or form of the media player. That is, the contour of the housing 102 may embody the outward physical appearance of the media player 100. The integrated circuit chips and other circuitry contained within the housing may include a microprocessor (e.g., CPU), memory (e.g., ROM, RAM), a power supply (e.g., battery), a circuit board, a hard drive, other memory (e.g., flash) and/or various input/output (I/O) support circuitry. The electrical components may also include components for inputting or outputting music or sound such as a microphone, amplifier and a digital signal processor (DSP). The electrical components may also include components for capturing images such as image sensors (e.g., charge coupled device (CCD) or complimentary oxide semiconductor (CMOS)) or optics (e.g., lenses, splitters, filters). The electrical components may also include components for sending and receiving media (e.g., antenna, receiver, transmitter, transceiver, etc.).

In the illustrated embodiment, the media player 100 includes a hard drive thereby giving the media player massive storage capacity. For example, a 20 GB hard drive can store up to 4000 songs or about 266 hours of music. In contrast, flash-based media players on average store up to 128 MB, or about two hours, of music. The hard drive capacity may be widely varied (e.g., 5, 10, 20 MB, etc.). In addition to the hard drive, the media player 100 shown herein also includes a battery such as a rechargeable lithium polymer battery. These type of batteries are capable of offering about 10 hours of continuous playtime to the media player.

The media player 100 also includes a user interface 103. The user interface 103 allows the user of the media player 100 to initiate actions on the media player 100 and provides the user with output associated with using the media player (e.g., audio, video, images, etc.). The user interface 103 may be widely varied. By way of example, the user interface 103 may include switches, buttons, keys, dials, trackballs, joysticks, touch pads, touch screens, displays, microphones, speakers, cameras, and the like.

In the illustrated embodiment, the media player 100 includes a display screen 104 and related circuitry. The display screen 104 is used to display a graphical user interface as well as other information to the user (e.g., text, objects, graphics). By way of example, the display screen 104 may be a liquid crystal display (LCD). In one particular embodiment, the display screen corresponds to a 160-by-128-pixel high-resolution display, with a white LED backlight to give clear visibility in daylight as well as low-light conditions. As shown, the display screen 104 is visible to a user of the media player 100 through an opening 105 in the housing 102, and through a transparent wall 106 that is disposed in front of the opening 105. Although transparent, the transparent wall 106 may be considered part of the housing 102 since it helps to define the shape or form of the media player 100.

In addition to the display screen 104, the media player 100 also includes a touch pad 110. The touch pad is an intuitive interface that provides easy one-handed operation, i.e., lets a user interact with the media player with one or more fingers. The touch pad 110 is configured to provide one or more control functions for controlling various applications associated with the media player 100. For example, the touch initiated control function may be used to move an object or perform an action on the display screen 104 or to make selections or issue commands associated with operating the media player 100. In order to implement the touch initiated control function, the touch pad 110 may be arranged to receive input from a finger moving across the surface of the touch pad 110, from a finger holding a particular position on the touch pad and/or by a finger tapping on a particular position of the touch pad. The touch pad may be widely varied. For example, the touch pad may be a conventional touch pad based on a Cartesian coordinate system, or the touch pad may be a touch pad based on a Polar coordinate system. Furthermore, the touch pad 110 may be used in a relative and/or absolute mode. In absolute mode, the touch pad 110 reports the absolute coordinates of where it is being touched. For example x, y in the case of the Cartesian coordinate system or (r, θ) in the case of the Polar coordinate system. In relative mode, the touch pad 110 reports the direction and/or distance of change. For example, left/right, up/down, and the like.

The touch pad 110 generally consists of a touchable outer surface 111 for receiving a finger for manipulation on the touch pad 110. Although not shown in FIG. 1, beneath the touchable outer surface 111 is a sensor arrangement. The sensor arrangement includes a plurality of sensors that are configured to activate as the finger sits on, taps on or passes over them. In the simplest case, an electrical signal is produced each time the finger is positioned over a sensor. The number of signals in a given time frame may indicate location, direction, speed and acceleration of the finger on the touch pad, i.e., the more signals, the more the user moved his or her finger. In most cases, the signals are monitored by an electronic interface that converts the number, combination and frequency of the signals into location, direction, speed and acceleration information. This information may then be used by the media player 100 to perform the desired control function on the display screen 104.

The position of the display screen 104 and touch pad 110 relative to the housing 102 may be widely varied. For example, they may be placed at any external surface (e.g., top, side, front, or back) of the housing 102 that is accessible to a user during manipulation of the media player 100. In most cases, the touch sensitive surface 111 of the touch pad 110 is completely exposed to the user. In the illustrated embodiment, the touch pad 110 is located in a lower, front area of the housing 102. Furthermore, the touch pad 110 may be recessed below, level with, or extend above the surface of the housing 102. In the illustrated embodiment, the touch sensitive surface 111 of the touch pad 110 is substantially flush with the external surface of the housing 102.

The shape of the display screen 104 and the touch pad 110 may also be widely varied. For example, they may be circular, rectangular, triangular, and the like. In general, the outer perimeter of the shaped touch pad defines the working boundary of the touch pad. In the illustrated embodiment, the display screen is rectangular and the touch pad 110 is circular. More particularly, the touch pad is annular, i.e., shaped like or forming a ring. When annular, the inner and outer perimeter of the shaped touch pad defines the working boundary of the touch pad.

In addition to above, the media player 100 may also include one or more buttons 112. The buttons 112 are configured to provide one or more dedicated control functions for making selections or issuing commands associated with operating the media player 100. By way of example, in the case of an MP3 music player, the button functions may be associated with opening a menu, playing a song, fast forwarding a song, seeking through a menu and the like. In most cases, the button functions are implemented via a mechanical clicking action. The position of the buttons 112 relative to the touch pad 110 may be widely varied. For example, they may be adjacent one another or spaced apart. In the illustrated embodiment, the buttons 112 are configured to surround the inner and outer perimeter of the touch pad 110. In this manner, the buttons 112 may provide tangible surfaces that define the outer boundaries of the touch pad 110. As shown, there are four buttons 112A that surround the outer perimeter and one button 112B disposed in the center or middle of the touch pad 110. By way of example, the plurality of buttons 112 may consist of a menu button, play/stop button, forward seek button and a reverse seek button, and the like.

Moreover, the media player 100 may also include a hold switch 114. The hold switch 114 is configured to activate or deactivate the touch pad and/or buttons. This is generally done to prevent unwanted commands by the touch pad and/or buttons, as for example, when the media player is stored inside a user's pocket. When deactivated, signals from the buttons and/or touch pad are not sent or are disregarded by the media player. When activated, signals from the buttons and/or touch pad are sent and therefore received and processed by the media player.

The media player 100 may also include one or more connectors for receiving and transmitting data to and from the media player. By way of example, the media player may include one or more audio jacks, video jacks, data ports and the like. The media player 100 may also include one or more connectors for receiving and transmitting power to and from the media player 100.

In the illustrated embodiment, the media player includes a headphone jack 116 and a data port 118. The headphone jack 116 is capable of receiving a headphone or speaker plug associated with headphones/speakers configured for listening to sound being outputted by the media device 100. The data port 118, on the other hand, is capable of receiving a data plug/cable assembly configured for transmitting and receiving data to and from a host device such as a general purpose computer (e.g., desktop computer, portable computer). By way of example, the data port 118 may be used to upload or down load audio, video and other images to and from the media device 100. For example, the data port may be used to download songs and play lists, audio books, ebooks, photos, and the like into the storage mechanism of the media player.

The data port 118 may be widely varied. For example, the data port may be a PS/2 port, a serial port, a parallel port, network interface port, a USB port, a Firewire port and/or the like. In some cases, the data port 118 may be a wireless link such as a radio frequency (RF) link or an optical infrared (IR) link in order to eliminate the need for a cable. Although not shown in FIG. 1, the media player 100 may also include a power port that receives a power plug/cable assembly configured for delivering powering to the media player 100. In some cases, the data port 118 may serve as both a data and power port.

Although only one data port is provided, it should be noted that this is not a limitation and that multiple data ports may be incorporated into the media player. In a similar vein, the data port may include multiple data functionality, i.e., integrating the functionality of multiple data ports into a single data port. Furthermore, it should be noted that the position of the hold switch, headphone jack and data port on the housing may be widely varied. That is, they are not limited to the positions shown in FIG. 1. They may be positioned almost anywhere on the housing (e.g., front, back, sides, top, bottom). For example, the data port may be positioned on the top, sides, back, front surfaces of the housing rather than the bottom surface as shown. Although it should be noted that having the data port on the bottom surface provides some benefits when connecting to other devices.

Figure 2:
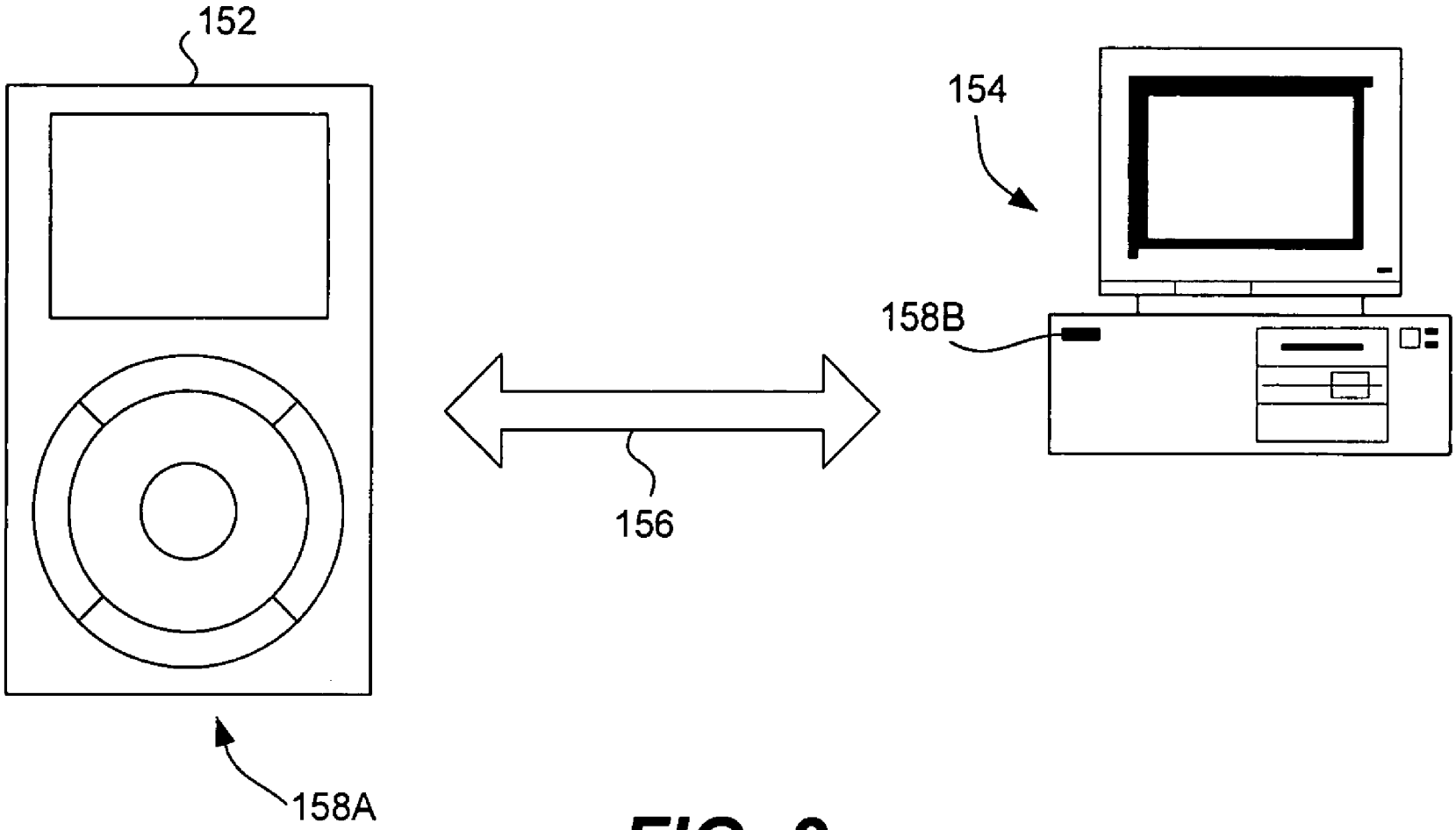
FIG. 2 is a diagram of a media player system, in accordance with one embodiment of the present invention.

FIG. 2 is a schematic diagram of a media player connection with another electronic system, in accordance with an embodiment of the present invention. A media player 152 is connected to another electronic device 154 by an interface connector 156. The electronic devices may be widely varied. By way of example, the devices may correspond to desktop computers, notebook computers, personal digital assistants, video or imaging equipment (e.g., cameras, monitors), audio equipment (home stereos, car stereos, boom boxes), family radios (e.g., walkie talkies), peripheral devices (e.g., keyboards, mice, displays, printers, scanners), other media players, personal media devices (discussed in greater detail below) and the like.

The electronic device 154 and the media player 152 are configured to communicate with one another through interface connector 156. When the media player is configured as a USB drive (i.e., as a portable memory device) the system is configured as would be the case for a standard USB flash drive. Additionally, the protocol under which the media player and electronic device communicate is standardized and well known to those having ordinary skill in the art. Additionally, the protocol arrangements can be widely varied. By way of example, the communication protocol may be a master/slave communication protocol, server/client communication protocol, peer/peer communication protocol, and the like. Using a master/slave communication protocol, one of the devices is a master and the other is a slave. The master controls the slave. Using a client/server communication protocol, a server program responds to requests from a client program. The server program may operate on the media player or the media device. Using a peer to peer communication protocol either of the two devices can initiate a communication session.

Typically, the interface connector 156 enables two-way communication between the media player and the electronic device. For example, both the media player and electronic device may be enabled to receive and transmit signals therebetween. The signals may be data (analog, digital), power (AC, DC), and/or the like. In most cases, the data corresponds to data associated with the media player as for example audio, video, images and the like. In particular, the system is configured to transmit memory information between the device and player.

Both the media player 152 and the associated electronic device 154 include a connector terminals 158A and 158B, respectively. The media terminals 158 provide a direct connection between the media player 152 and the electronic device 154 (e.g., a computer). In such connections, the media terminals 158 are configured to physically and operatively connect the media player 152 to the electronic device 154. For example, the media player 152 and the electronic device 154 includes a connection having a pair of connection ports (one on the media player and on the electronic device) and an interface connector 156 compatible with both ports. By way of example, the connection interface connector and ports may include one or more of the following interfaces: PS/2, serial, parallel, network (e.g., Ethernet), USB, Firewire and/or the like.

In one particular embodiment the electronic device port is a USB (Universal Serial Bus) port and the media player port is an iPod universal docking port. The interface connector includes an end connector compatible with each of these ports.

Figure 3C:
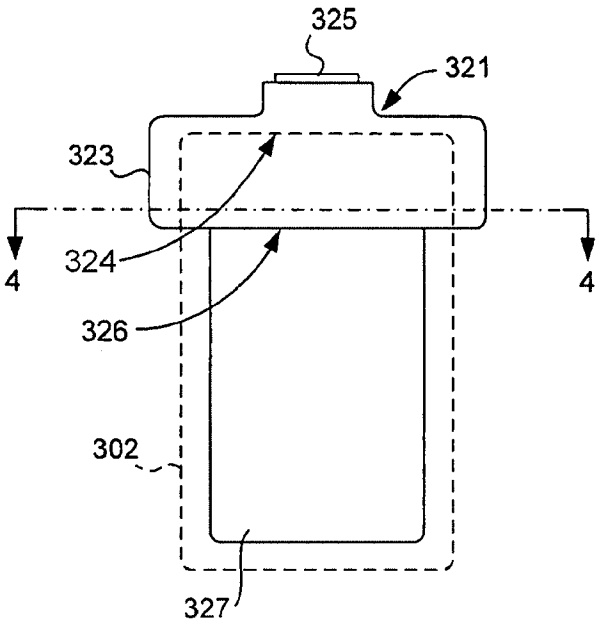
FIGS. 3(*a*), 3(*b*) and 3(*c*) are top views illustrating various embodiments of connector interfaces used to enable various aspects of the present invention.
Figure 3B:
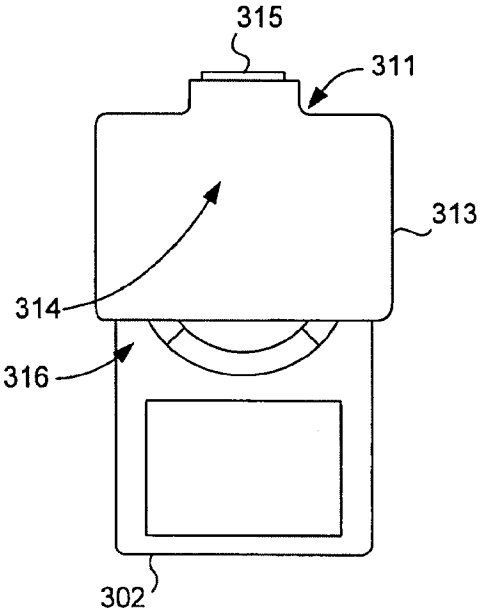
Figure 3A:
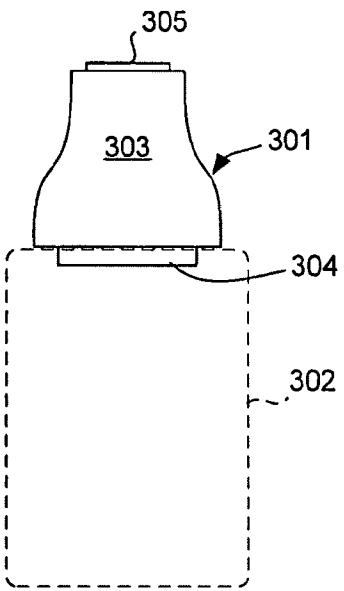

FIGS. 3(*a*), 3(*b*), and 3(*c*) are diagrams of various connector interfaces for connecting the media players with the other electronic devices. The connector interfaces 301, 311, and 321 are hardware components that include a set of end connectors configured to allow a media player 174 to transmit data to and receive data from another electronic device. That is, the connector interfaces 301, 311, and 321 make available additional functionality that would not otherwise be achieved through the media player. The connector interfaces 301, 311, and 321 are small separate components that enable electronic data transmission between the media player 302 (shown also by dashed lines) and an associated electronic device. By way of example, the media player 302 may generally correspond to the media player shown in FIG. 1.

With reference to FIG. 3(*a*), the inventor points out that the connector interface 301 can be of almost any size. However, applicants note that small sizes are particularly advantageous. In one implementation, the connector interface 301 is about one inch long and less than two inches wide being less than about ½ inch thick. As is known to those having ordinary skill in the art many other sizes are applicable. The forgoing dimensions are particularly useful due to the small size involved.

As shown, each of the connector interfaces 301, 311, and 321 includes a housing 303, 313, 323. The housings 303, 313, 323 are configured to include an end connector 304, 314, 324 capable of coupling with an access port of the media player 302. In one embodiment, the access port of the media player comprises an iPod universal docking port. Additionally, the housings include another end connector 305, 315, 325 configured to electrically connect with the electronic device. In the depicted embodiments the end connectors 305, 315, 325 enable connection with a USB port of an electronic device. In particular, housings 313 and 323 include media player attachment bays 316 and 326. These bays are openings in an end of the housings. At the base of the bays are located end connectors 314 and 324. The attachment bays are configured to physically receive the media player 302. In other words, the media player 302 can be inserted into the bay openings 316, 326. Once the media player 302 is inserted into the bay and connected with the end connector the combination (housing and player) can be plugged into the electronic device to enable communication between player and another electronic device.

Figure 4:
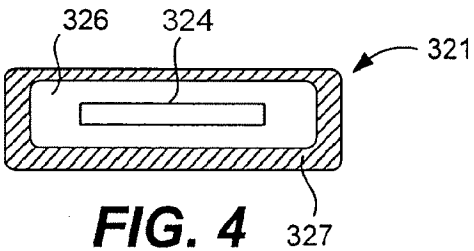
FIG. 4 is a cross-sectional view of the interface embodiment such as shown in FIG. 3(*c*) in accordance with the principles of the invention.

Further referring to FIGS. 3(*c*) & 4 a connector embodiment is shown. FIG. 4 is a cross-section depiction of the interface connector 321 shown in FIG. 3(*c*). FIG. 4 clearly depicts the bay opening 326 and the end connector 324. Also, a support tab 327 is also depicted. The support tab further supports the media player 302. Although many different embodiments are contemplated as being within the scope of the invention, the inventors point out that the embodiment shown in FIG. 3(*a*) is the most compact and therefore the most preferred embodiment.

The bay openings 316, 326 of the interface connectors 311, 321 may be widely varied. In most cases, bay openings 316, 326 are dimensioned to receive the media players 302. That is, the inner peripheral surfaces of the bay openings 316, 326 are sized to receive the outer peripheral surfaces of the media player 302 (allowing for some tolerances). In the depicted embodiments, the end connectors 314, 324 of the interface connectors 311, 321 are configured to connect with the media player plug (e.g., 158A) when the media player 302 is inserted in the bay openings 316, 326. The position of the inserted player 302 relative to the interface connectors 311, 321 may be widely varied. For example, the bay openings 316, 326 may be configured to receive the entire media player 302 or it may only be configured to receive a portion of the media player 302.

The media player 302 typically retains the end connector 304, 314, 324, until it is disconnected from the interface connectors 301, 311, 321 (e.g., doesn't slide out). For example, a retention mechanism such as a snap, a spring loaded latch or a magnet may be used to hold the media player 302 together with the interface connectors 301, 311, 321. The media player 302 may also be retained by the interface connectors 301, 311, 321 by the force of engaged connectors of the end connector and an end connector (e.g., 304/158A). An ejection mechanism may additionally be used to release the media player 302 from the interface connectors 301, 311, 321 (e.g., to overcome any holding forces).

Figure 5:
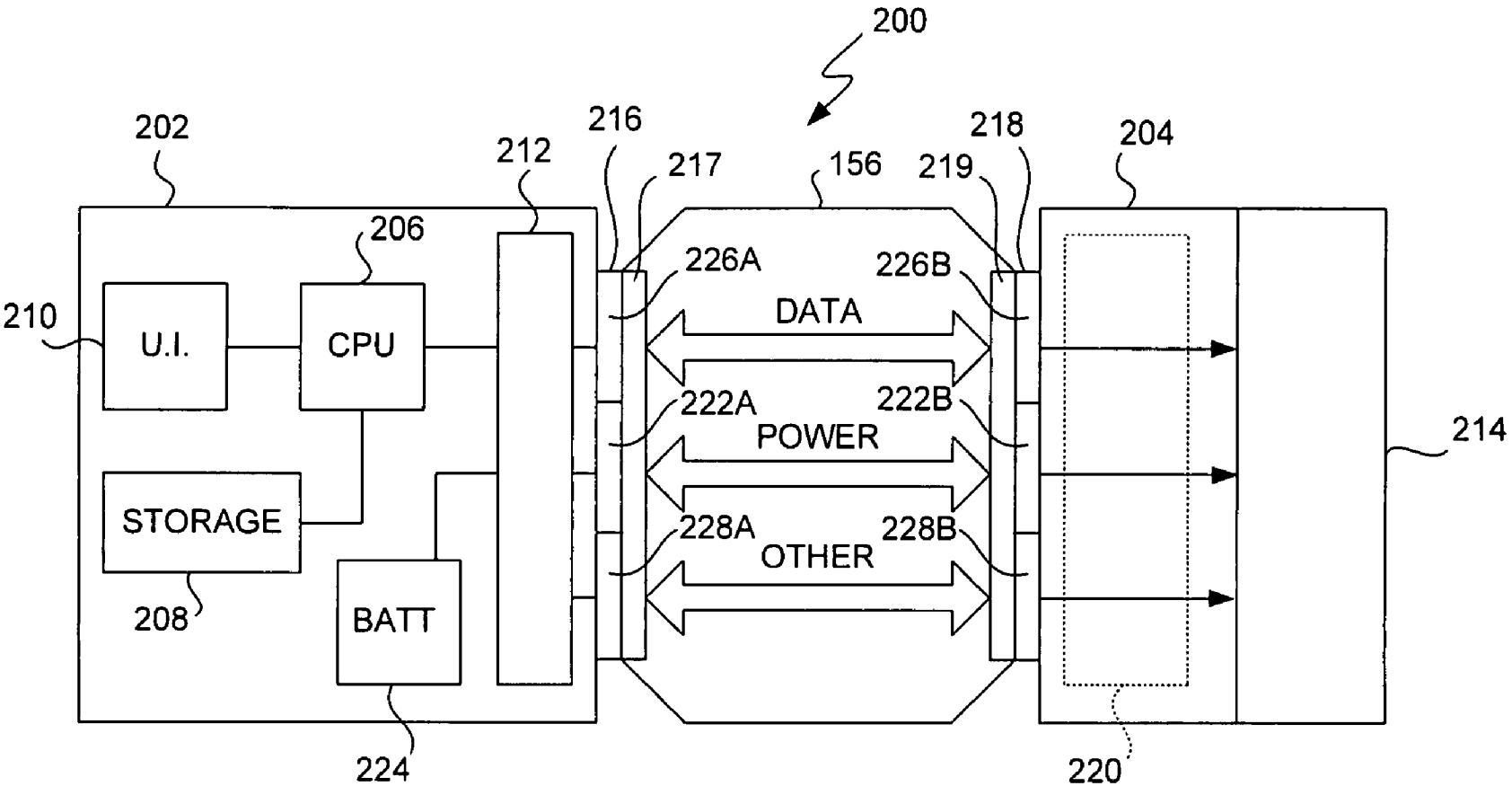
FIG. 5 is a block diagram of a media player system, in accordance with one embodiment of the present invention.

FIG. 5 is a block diagram of a media player/electronic device system 200, in accordance with one embodiment of the present invention. The system 200 generally includes a media player 202 and another electronic device 204. By way of example, the media player and electronic device may correspond to the media player and CPU shown in FIG. 2. As shown, the media player 202 includes a processor 206 (e.g., CPU or microprocessor) configured to execute instructions and to carry out operations associated with the media player 202. For example, using instructions retrieved for example from memory, the processor 206 may control the reception and manipulation of input and output data between components of the media player 202. In most cases, the processor 206 executes instruction under the control of an operating system or other software. The processor 206 can be a single-chip processor or can be implemented with multiple components.

In most cases, the processor 206 together with an operating system operates to execute computer code and produce and use data. The computer code and data may reside within a program storage block 208 that is operatively coupled to the processor 206. Program storage block 208 generally provides a place to hold data that is being used by the system 200. By way of example, the program storage block 208 may include Read-Only Memory (ROM), Random-Access Memory (RAM), hard disk drive, flash memory and/or the like. As is generally well known, RAM is used by the processor as a general storage area and as scratch-pad memory, and can also be used to store input data and processed data. ROM can be used to store instructions or program code followed by the processor as well as other data. Hard disk drives can be used to store various types of data and can permit fast access to large amounts of stored data. The computer code and data could also reside on a removable program medium and loaded or installed onto the computer system when needed.

Importantly, this storage can be used to store any memory data that a user may desire. For this reason, the inventors contemplate that the media player can be used to be operated as a USB memory drive, thereby extending the versatility of the media player.

Also, program storage block 208 can be configured to store audio programs for controlling the distribution of audio in the media player 202. The audio program may contain song lists associated with songs also stored in the storage block 208. The songs may be accessed through a user interface 210 operatively coupled to the processor 206. The user interface 210 may include a display for visually displaying the song lists (as part of a GUI interface) and a touch pad or buttons for selecting a song to be played or reviewing and/or customizing the song lists, i.e., the user may quickly and conveniently review the lists and make changes or selections thereto. Additionally, the interface 210 can be used to identify and access other stored data files thereby permitting the media player to act as a general storage device.

The media player also includes an input/output (I/O) controller 212 that is operatively coupled to the processor 206. The (I/O) controller 212 may be integrated with the processor 206 or it may be a separate component as shown. The I/O controller 212 is generally configured to control interactions with one or more media devices 214 that can be coupled to the media player 202. The I/O controller 212 generally operates by exchanging data (and/or power) between the media player 202 and the media devices 214 that desire to communicate with the media player 202. In some cases, the media devices 214 may be connected to the I/O controller 212 through wired connections and in other cases the media devices 214 may be connected to the I/O controller 212 through wireless connections. In the illustrated embodiment, the media device 214 is capable of being connected to the I/O controller 212 through a wired connection.

The media player 202 also includes a connector 216 capable of connecting to a corresponding connector 217 of a connector interface 156. The interface has another connector 219 (which is electrically connected with connector 217) enabling communication with a communication port 218 of another electronic device 204 (e.g., a CPU or processor).

The connector interface 156 used to connect the media player 202 and another electronic device 204 may be widely varied. However, in the illustrated embodiment, the connector interface 156 includes a rigid interface housing having both power and data contacts. The power contacts 222 of the media player 202 are operatively coupled to a battery 224 of the media player 202 and the data contacts 226 of the media player 202 are operatively coupled to the I/O controller 212. As should be appreciated, the power contacts 222A of the connector 216 are configured to engage the power contacts 222B of the connector interface 156 and thereby connect the connector interface 156 to connector 218 of the electronic device 204. In this way operational or charging power can be provided to the media player 202, and the data contacts 226A of the connector 216 are configured to engage the data contacts 226B of the connector 218 so as to provide data transmissions to and from the media player 202. The data contacts may be widely varied. For example, they may be configured to provide one or more data transmitting functionalities including Firewire, USB, USB 2.0, Ethernet, and the like. The connectors may also include a variety of other contacts 230 for transmitting other types of data as for example remote control, video (in/out), audio (in/out), analog TV, and the like.

Figure 6B:
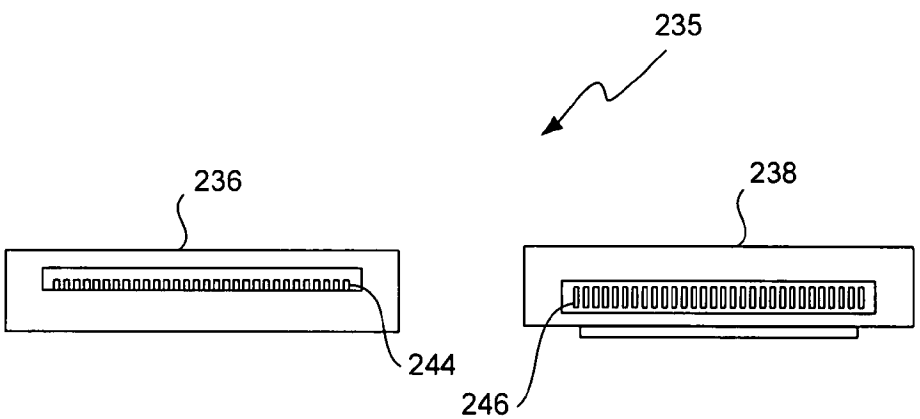
FIG. 6B shows end on views of the first and second ends of the connector interface shown in FIG. 6A, in accordance with one embodiment of the present invention.
Figure 6A:
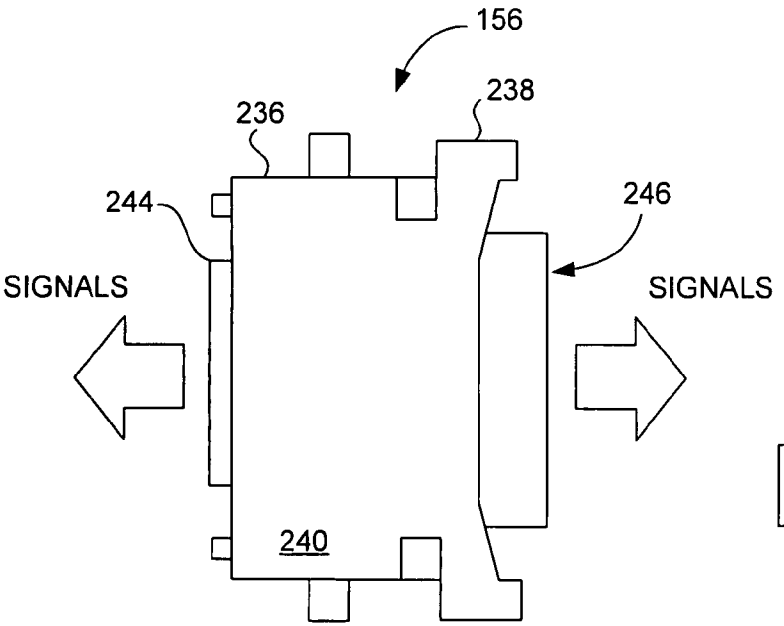
FIG. 6A is a top view of a connector interface, in accordance with one embodiment of the present invention.

FIGS. 6A and 6B are diagrams of an embodiment of a connector interface 156 including a connector assembly pin arrangement, in accordance with one embodiment of the present invention. As shown, the arrangement includes a first end connector 236 and a second end connector 238. The connectors 236 and 238 are located in a rigid housing 240. By way of example, the connectors 236 and 238 may generally correspond to the connectors 217/219 of FIG. 5. The first and second connectors 236 and 238 are encased in the housing 240 and include a plurality of corresponding contacts 244 and 246 that when engaged operatively couple the media player and the added electronic device together. The housing is generally formed from an insulating material such as plastic and the contacts are generally formed from an electrically conductive material such as a copper alloy. In the illustrated embodiment, the contacts 244 protrude from the housing 240 for insertion into corresponding recessed contacts of the media player (e.g., male-female connection). In some cases, the contacts 244 are configured to snugly fit into the recessed contacts of the media player so that the connectors are held together. Additionally or alternatively, the connectors 236 and 238 may include a locking means for locking the connectors together. For example, one of the connectors may include a latch that engages and disengages to and from a portion of the other connector. The configuration of the contacts may be widely varied (e.g., spacing, # of rows or columns, etc.). In the illustrated embodiment, the contacts are spaced apart in a single row. The connectors may be manufactured using a variety of techniques. By way of example, the connectors may be manufactured using techniques similar to those used by JAE of Japan.

The signals carried by the contacts may be widely varied. For example, a portion of the contacts may be dedicated to Firewire signals while another portion may be dedicated to USB signals. The contacts may also be used for grounds, charging, powering, protocols, accessory identification, audio, line-in, line-out, and the like. Additional contacts may be used for grounding the housing of the connector. The number of contacts may also be widely varied. The number generally depends on the signals needed to support the devices using the connectors. In one embodiment, some of the contacts are used to support Firewire while other contacts are used to support USB. In this embodiment, the minimum number of contacts corresponds to the number required to support these devices. In most cases, however, the number of contacts tends to be greater than this number (other signals are needed). In the illustrated embodiment, each of the connectors includes at least 30 contacts, including Firewire contacts, USB contacts, grounding contacts, powering contacts, reserved contacts and the like. An example of a pin count which may used can be seen in FIG. 6C. Although this pin count is shown, it should be noted that it is not a limitation and that any configuration of the functions described therein may be used.

However, the inventor specifically contemplates that any number of contacts sufficient to transfer memory and data between the media player and the electronic device can be used in accordance with the principles of the invention.

Figure 7B:
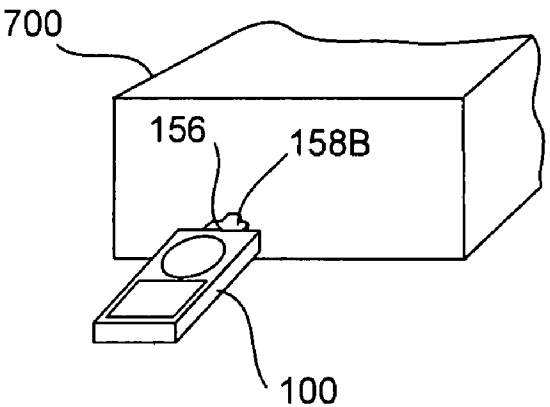
FIG. 7B is a perspective diagram of a connector interface engaging with a media player and CPU in accordance with an embodiment of the present invention.
Figure 7A:
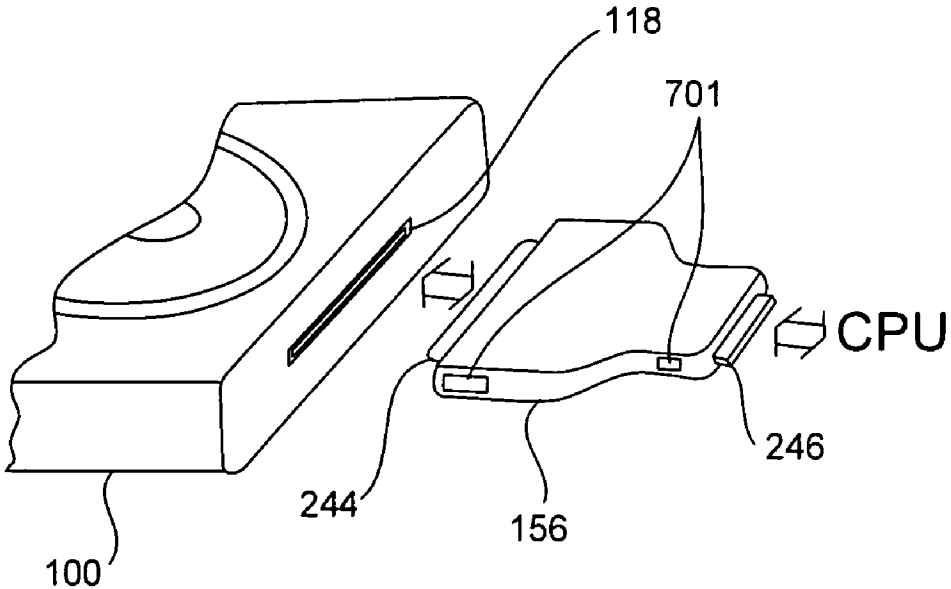
FIG. 7A is a perspective diagram of a connector interface engaging with a media player in accordance with an embodiment of the present invention.

FIGS. 7A-7B are diagrams that illustrate an implementation embodiment of the invention. A media player (e.g., an iPod) 100 having a data port 118 is connected with a connection interface 156. By inserting end connector 244 into the data port 118 of the media player 156 and inserting second end connector 246 into a communication port of a computer (CPU or other processor) 700 a data link between media player and computer are established. In one implementation, the communication port of the computer 700 is a USB compatible port 158B. In one embodiment clamp feature hold the connection interface 156 in firm contact with the media player 100 and the computer 700. By pressing detachment pins 701 the latches can be released and the connection interface 156 can be disconnected.

Once the media player 100, connection interface 156, and computer 700 are connected the media player can be used as a USB memory device. Either data can be transferred from the computer 700 to the media player 100 as a destination memory or data stored on the media player 100 can be transferred from the media player 100 to the computer 700. Thus the media player 100 can be used as a memory transfer location or a sand alone docking station 250, in accordance with one embodiment of the present invention. The small size of the connection interface 156 enables the interface to be easily transported with the media player for quick easy memory usage.

Furthermore, the present invention includes a method for transferring data between the media player 100 and the CPU 700. In particular, such data may include non-audiovisual files. This means other types of data beyond .MP3, .WAV, .AIFF, .RA (Real Audio files), MIDI and the like can be stored and retrieved in the media player enabling it to function much as a USB memory device (e.g., such as flash memory products).

While this invention has been described in terms of several preferred embodiments, there are alterations, permutations, and equivalents, which fall within the scope of this invention. For example, although the invention has been described in terms of an MP3 music player, it should be appreciated that certain features of the invention may also be applied to other types of media players such as video recorders, cameras, and the like. Furthermore, the MP3 music player described herein is not limited to the MP3 music format. It is therefore intended that the following appended claims be interpreted as including all such alterations, permutations, and equivalents as fall within the true spirit and scope of the present invention.

What is claimed is:

1. An interface for connecting a handheld media player with an electronic device, the interface comprising:

a first end connector configured for direct engagement with a connection port of the handheld media player, the first end connector having a housing designed to accommodate at least thirty electrical contacts spaced apart in a single row of thirty sequentially numbered contact locations, the thirty sequentially numbered contact locations including:

contact locations 3 through 9 designated to carry digital signals including USB signals, and contact locations 25 through 28 designated to carry analog signals including analog audio signals;

a second end connector having a plurality of electrical contacts that are electrically coupled to a corresponding plurality of contacts of the first end connector, the plurality of electrical contacts of the second end connector being exposed to enable engagement with a connector coupled to the electronic device and a rigid housing accommodating the first end connector and the second end connector, the first end connector being maintained in a fixed orientation with respect to the second end connector such that the first and second end connectors are substantially aligned along a plane vertically bisecting the first end connector and the second end connector, the rigid housing having a compact shape and a bay opening, surrounding the first end connector and extending beyond a width of the second end connector, for receiving the media player, wherein, when the first end connector of the interface is in direct engagement with the connection port of the handheld media player, the resulting combination of the handheld media player and the interface yields a compact handheld system for connecting the handheld media player to the electronic device.

2. The interface of claim 1 wherein the bay opening is configured to receive a portion of the handheld media player.

3. The interface of claim 1 wherein the first end connector includes a retention mechanism to hold the handheld media player.

4. The interface of claim 1 wherein the plurality of electrical contacts of the second end connector are in a single row.

5. The interface of claim 1 wherein the contacts of the first end connector fit snugly into recessed contacts of the handheld media player.

6. The interface of claim 1 wherein the first end connector and the second end connector are placed on opposite ends of the rigid housing.

7. The interface of claim 1 wherein the second end connector accommodates a smaller number of electrical contacts than the first end connector, and wherein the width of the first end connector, with respect to the direction of the single row of contacts, is larger than the width of the second end connector.

8. The interface of claim 1 wherein the thirty sequentially numbered contact locations further comprise contact locations 3, 5, 7 and 9 designated for Firewire signals.

9. The interface of claim 1 wherein the thirty sequentially numbered contact locations further comprise contact locations 4, 6, and 8 designated for USB signals.

10. The interface of claim 1 wherein the thirty sequentially numbered contact locations further comprise contact locations 8, 11 or 12 designated for power.

11. The interface of claim 1 wherein the thirty sequentially numbered contact locations further comprise contact location 10 designated for an accessory identify signal that has an associated electrical pull down function to notify the handheld media player of a specific device.

12. The interface of claim 1 wherein the thirty sequentially numbered contact locations further comprise:

contact location 13 designated for an accessory power signal that can receive power from the handheld media player; and contact location 20 designated for an accessory detect signal.

13. The interface of claim 1 wherein the thirty sequentially numbered contact locations further comprise contact locations 18 and 19 designated for serial protocol signals.

14. The interface of claim 1 wherein the plurality of electrical contacts of the second end connector protrude from the rigid housing.

15. An interface for connecting a handheld media player with an electronic device, the interface comprising:

a first end connector having a housing designed to accommodate a first plurality of contacts spaced apart in a single row of contact locations, wherein the contact locations are sequentially numbered from a first end to a second end, the contact locations including:

a first ground contact location designated for ground, a first group of digital contact locations designated for one or more digital signals including USB, the first group of digital contact locations being disposed between the first ground contact location and the first end, a second group of analog contact locations designated for one or more analog signals including at least one audio signal, the second group of analog contact locations being disposed between the first ground contact location and the second end;

a second end connector having a second plurality of electrical contacts that are electrically coupled to a corresponding plurality of contacts of the first end connector, the second plurality of electrical contacts of the second end connector being exposed to enable engagement with a connector coupled to the electronic device, a rigid housing accommodating the first end connector and the second end connector, the first end connector being maintained in a fixed orientation with respect to the second end connector, the rigid housing having a bay opening, surrounding the first end connector and extending beyond a width of the second end connector, for receiving the handheld media player and a support tab extending away from the first end connector outside the bay opening, the support tab sized to physically support the handheld media player when the first end connector of the interface is in direct engagement with the connection port of the handheld media player, the resulting combination of the handheld media player and the interface yielding a compact handheld system for connecting the handheld media player to the electronic device.

16. The interface of claim 15 wherein the bay opening is configured to receive a portion of the handheld media player.

17. The interface of claim 15 wherein the first end connector includes a retention mechanism to hold the handheld media player.

18. The interface of claim 15 wherein the plurality of electrical contacts of the second end connector protrude from the rigid housing.

19. The interface of claim 15 wherein the plurality of electrical contacts of the second end connector are in a single row.

20. The interface of claim 15 wherein the contacts of the first end connector fit snugly into recessed contacts of the handheld media player.

21. The interface of claim 15 wherein the first end connector and the second end connector are placed on opposite ends of the rigid housing.

22. The interface of claim 15 wherein the second end connector accommodates a smaller number of electrical contacts than the first end connector, and wherein the width of the first end connector, with respect to the direction of the single row of contacts, is larger than the width of the second end connector.

23. The interface of claim 15 wherein contact locations from the first group of digital contact locations that are designated for USB are disposed consecutively in every other contact location.

24. The interface of claim 15 wherein the plurality of contact locations comprises at least 30 contact locations, and wherein the first ground contact location is at contact location 16, the second ground contact location is at contact location 1, and the third ground contact location is at contact location 30, and wherein the sequentially numbered contact locations further include additional ground contact locations 2, 15, and 29 designated for ground.

25. The interface of claim 15 wherein the first group of digital contact locations comprises locations 3 to 9, and wherein the second group of analog contact locations comprises locations 25 to 28.

26. The interface of claim 15 wherein the first group of digital contact locations comprises locations 3, 5, 7 and 9 designated for Firewire signals.

27. The interface of claim 15 wherein the first group of digital contact locations comprises locations 4, 6, and 8 designated for USB signals.

28. The interface of claim 15 further comprising a plurality of contacts made of electrically conductive material disposed at the plurality of contact locations, respectively, wherein at least a subset of the plurality of contacts can be active when the plug connector is connected to the corresponding receptacle connector of the handheld media player.

29. The interface of claim 15 further comprising one or more power contacts made of electrically conductive material disposed in one or more of contact locations 8, 11 or 12.

30. The interface of claim 15 wherein the contact locations further comprise an accessory identify contact location 10 designated for an accessory identify signal that has an associated electrical pull down function to notify the handheld media player of an accessory identification.

31. The interface of claim 15 wherein the contact locations further comprise:

an accessory power contact location 13 designated for an accessory power signal that can receive power from the handheld media player; and an accessory detect contact location 20 designated for an accessory detect signal.

32. The interface of claim 15 wherein the contact locations further comprise serial protocol contact locations 18 and 19 designated for serial protocol signals.

* * * * *